US006691761B1

(12) United States Patent
Alkhoury et al.

(10) Patent No.: US 6,691,761 B1
(45) Date of Patent: Feb. 17, 2004

(54) ROLL UP SCREEN EDGE CONTROL

(75) Inventors: Boulos Paul Alkhoury, Woodbridge (CA); Pasqualino D'Uva, Woodbridge (CA); Arturo Grassi, Mississauga (CA); Philip Spatafora, Woodbridge (CA)

(73) Assignee: Viper Profile Limited, Woodbridge (CA)

( * ) Notice: Subject to any disclaimer, the term of this patent is extended or adjusted under 35 U.S.C. 154(b) by 0 days.

(21) Appl. No.: 10/136,408

(22) Filed: May 2, 2002

(51) Int. Cl.[7] ..... E06B 9/56
(52) U.S. Cl. ..... 160/273.1; 160/98
(58) Field of Search ..... 160/273.1, 270, 160/271, 272, 98, 265

(56) References Cited

U.S. PATENT DOCUMENTS 2,132,986 A * 10/1938 Julien ..... 160/273.1
2,501,454 A * 3/1950 Schueren ..... 160/273.1
2,689,004 A * 9/1954 Der Horst ..... 160/273.1
2,908,326 A * 10/1959 Jewell ..... 160/273.1

* cited by examiner

*Primary Examiner*—David Purol
(74) *Attorney, Agent, or Firm*—R. L. Westell

(57) ABSTRACT

A rolled screen for a screen opening which may be part of a casement window frame unwinds to close the screen opening. The extended lateral edges of said screen pass through lateral slots and the screen is shaped or treated to prevent the movement of edges inwardly through the slots.

3 Claims, 4 Drawing Sheets

FIG. 1.
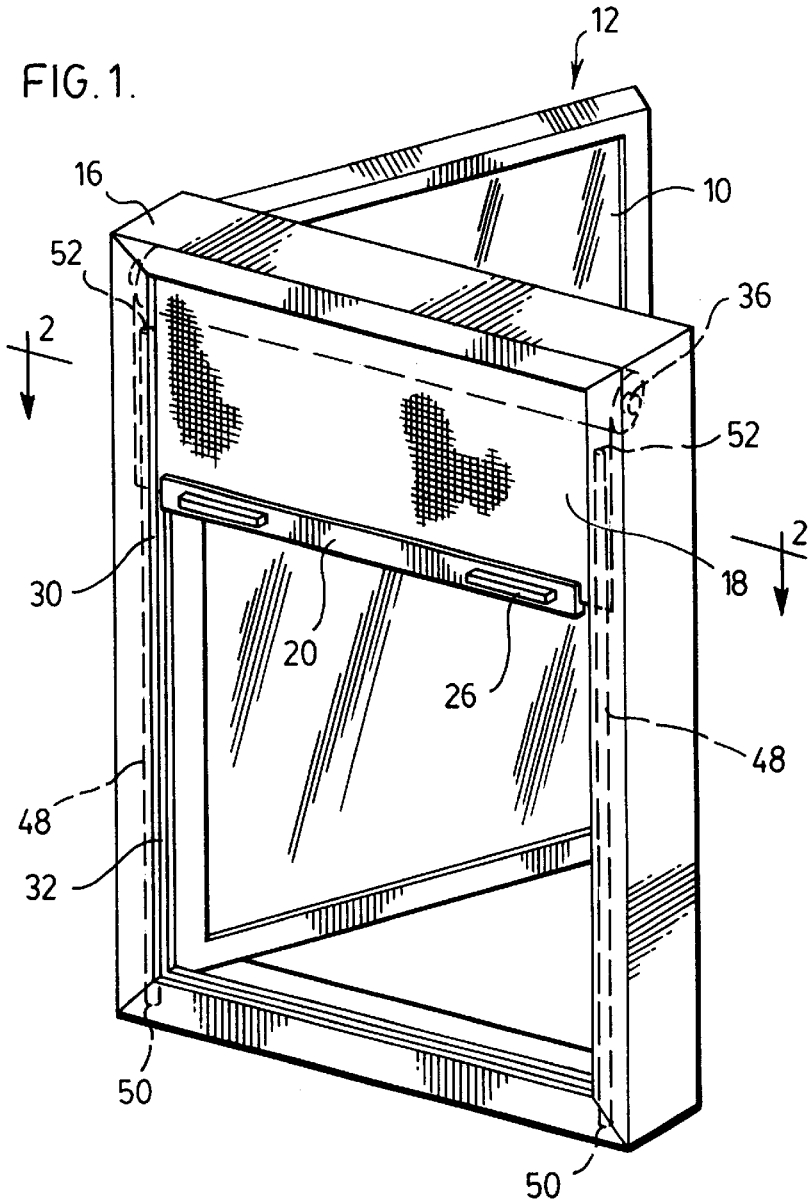
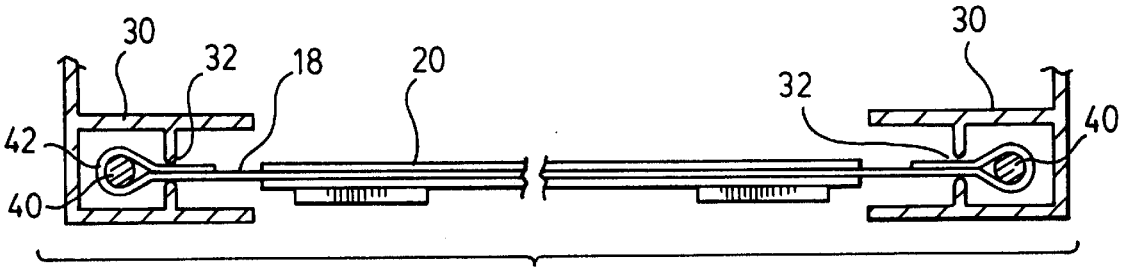
FIG. 2.

ROLL UP SCREEN EDGE CONTROL

This invention is direct mean for controlling the lateral edge locations of a roll window screen in a window opening or other opening in a wall.

BACKGROUND OF THE INVENTION

A frame with which the invention may be used defines a window opening and a screen opening or a screen opening alone. This opening is often closable on the building's outer side by a pivotally mounted casement window comprising a glazing unit in a frame hinged to open outwardly relative to the building wall. The opening is closable or partially closable on the building's inner side by a screen, which is, in rolled up attitude, wound like a window blind on a roll located on the frame member at one side of the opening, which may be longitudinally unrolled to a partially or fully extended position. The screen has lateral edges and has, between those edges, an area intended to close the window opening to the extent of the screen's extension. Although the rolled up screen may be located at the top, bottom or either side of the opening it is usually located at the top.

FIELD OF THE INVENTION

Difficulty is presently encountered with existing screens because the lateral screen edges tend, in use, to migrate or pull away laterally inwardly toward each other. Such migration and pulling away will leave open areas on one or both lateral sides of the extended portion of the screen and also leaves an untidy impression. Present screen and frame designs do not prevent such inward migration or pulling away.

This invention provides distinct features of the screen and the frame, which act so that the screen edges close the opening between lateral sides and do not migrate or 'pull away' from the lateral edges.

The inventive screen and its mounting are usually found in a frame installed in a building wall opening. Such a frame, toward the outside of the building from the screen, usually mounts a glazing unit which is hinged to swing outwardly relative to the building while the frame mounts a screen inwardly from the closed position of the window movable between extended and retracted position.

BRIEF SUMMARY OF THE INVENTION

In accord with the invention the frame is provided with means for mounting a screen roll in position to unwind, to partially extended or extended position in the window opening, usually under control of a draw bar. In winding or unwinding, the lateral edges of the screen follow paths designed to be outside of the edges of the window opening. The screen may be of any material which is flexible enough to roll on a roller, such as plastic or aluminum mesh or fibreglass coated with plastic.

In accord with the invention, the frame provides two spaced members defining slots facing each other and extending along the screen path and the slots are dimensioned to receive the partially extended screens near the lateral edges so that, on each side, the edges are laterally outwardly of the slots. The lateral edges of the screens are then shaped or combined with frame based members so that the screen lateral edges are prevented from travelling inwardly through the slots and are maintained laterally outwardly of the slots, whether the screen is travelling or stationary, resulting in the closing of that part of the opening between the lateral screen edges and providing a neat appearance for the screen.

Screens for use with the invention are typically although not necessarily composed of fibreglass coated with plastic. They are designed to roll up in a relatively compact roll in the retracted position. Thus any modification to the screen, to assist it in operating in accord with the invention, must not unduly interfere with its relatively compact rolling qualities. The retracted position of the screen is usually above the top of the window opening so that the free edge of the screen moves to the frame bottom to close the opening. However the screen roll can be at one side of the window opening so that it unrolls to extended position at the opposite side. The screen roll can alternatively be at the lower side of the window opening provided if there are means to retain the draw bar in place at selected settings.

In a preferred form of the invention, in the path of each edge adjacent, respective lateral sides of the screen, a rod is provided (laterally outwardly of each slot), from an attachment to the frame beyond screen extension travel, to a free end adjacent the roll position. The screen is preferably folded or welded and glued, to provide a tube at each lateral edge the tube being dimensioned to ride on the post. The screen where it is folded and welded or glued to form a sleeve must in positions which in the travel of the screen are free of the rod, be able to be flattened to a relatively thin size to wind on the roller.

The screen where the pocket surrounds the rod has a thickness which is diametrically larger than that of the slot. Thus the screen, partially extended must extend from the rod on one side through a slot, across the opening between the extended positions and through the other slot. Thus the action of the slots to prevent inward movement of the bolt-swollen screen edges, maintains both the closure between the lateral edges and the neat appearance of the screen.

Alternatives are within the scope of the invention. Alternate means are described for shaping or treating the screen adjacent the lateral edges so that they must stay laterally outside of the slots.

An alternative to the tube surrounding the screen tubes, involves the provision of each screen, with edge adjacent strips which may be strengthened relative to the strip, if necessary. The strips are located to be outside the slots which receive a partially extended screen. The strips are mini-slotted regularly to receive conveyor teeth. An endless belt with teeth is mounted to rotate with the teeth finding the mini slots while the teeth are transverse to the slot. Thus the teeth, located outside the frame slot, prevent escape of the strip edges of the screen through the slots and maintain a neat appearance of the screen.

BRIEF DESCRIPTION OF THE SEVERAL VIEWS OF THE INVENTION

In drawings which illustrate a preferred embodiment of the invention:

FIG. 1 is a schematic perspective of a casement window and screen,

FIG. 2 is a horizontal cross-section along the lines 2—2 of FIG. 1,

DETAILED DESCRIPTION OF THE INVENTION

Figure 3:
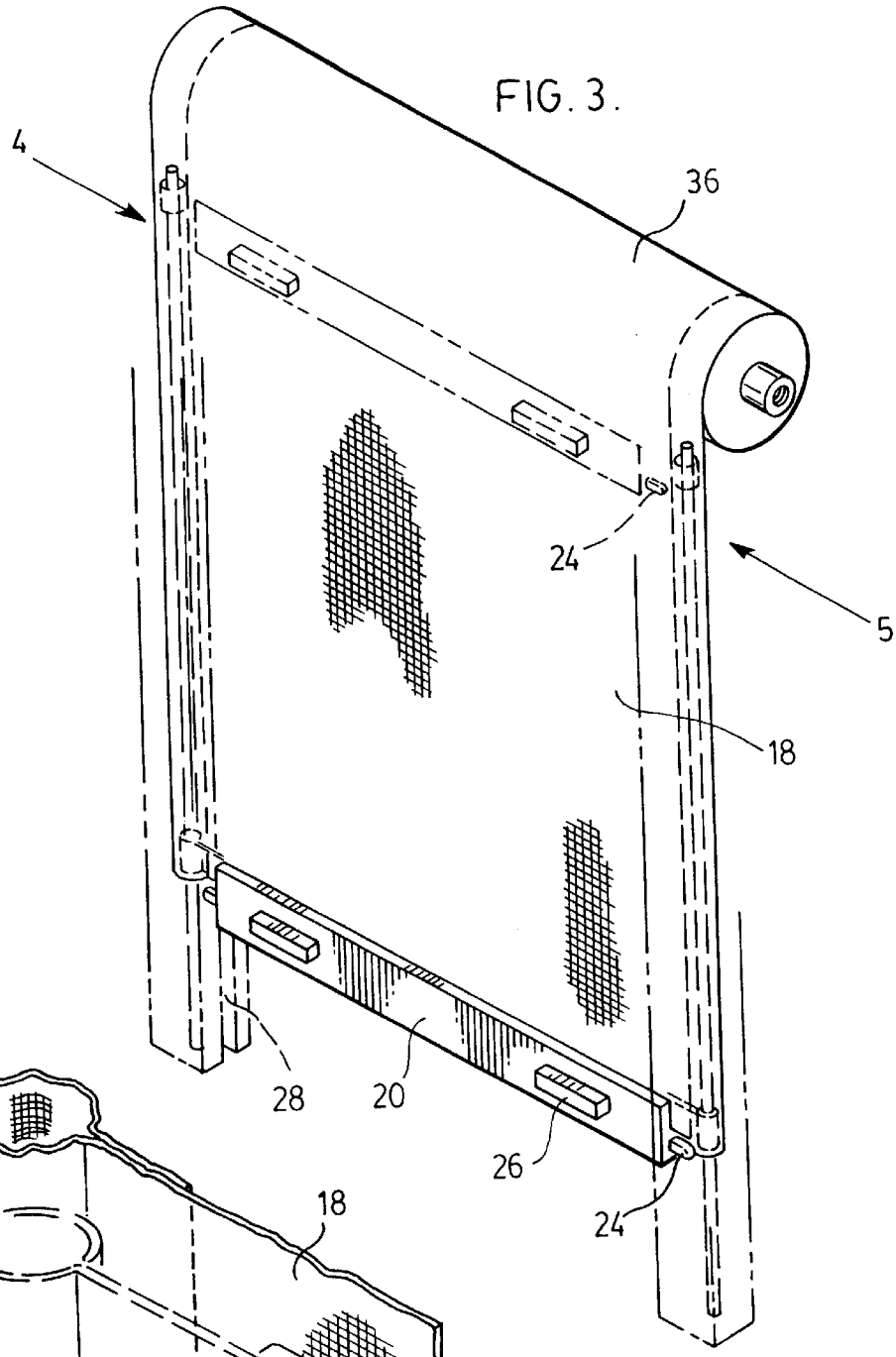
FIG. 3 is a perspective view of the screen partially extended.
Figure 4:
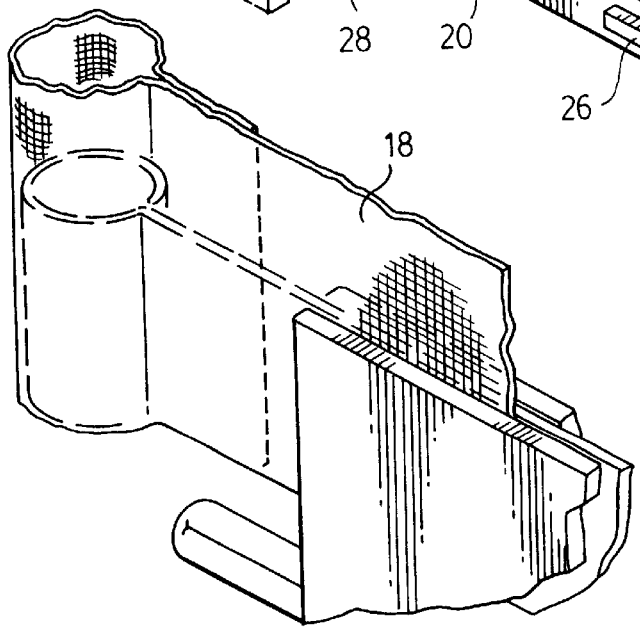
FIG. 4 shows an enlarged view of the screen, draw bar ring and draw bar at 4 of FIG. 3.

FIGS. 1 and 2 show the main parts of the casement window and screen. FIGS. 1 and 2 show a casement window frame 16 having window 10 including a glazing unit mounted in a sash 12 hinged to the frame 16. The frame 16 also houses a screen 18 vertically movable between extended, partly extended and rolled up positions, under control of a draw bar 20, The window unit is on the remote side of FIG. 1, in the drawing, corresponding to the outside of the house or building and the screen unit is on the adjacent side of FIG. 1 and corresponds to the inside of the house or building.

Details of the glazing unit may be standard and well known. The common unit has twin panes of glass (not shown) in a sealed unit. The window swings on hinges not shown from closed through the partially open position shown, to fully open.

The screen opening is laterally defined by vertical frame extrusions 30 at each side of the opening. As will be seen the extrusions define inwardly facing grooves 32 (FIGS. 1 and 2) or 34 (FIG. 7) through which the screen passes.

As shown in the drawings the screen 18 is wound on a roll 36 preferably of the type to keep screen 18 always under tension toward the retracted position and whose mechanism may resemble that used for older fashioned pull window blinds.

Thus the screen 18 is preferably constantly under tension in which case draw bar 20 is preferably provided with stud 24 spring loaded toward extension (FIG. 5) and socket means, not shown, are provided for the studs 24 which allows the screen to be left at fully extended position or partially extended positions.

Figure 5:
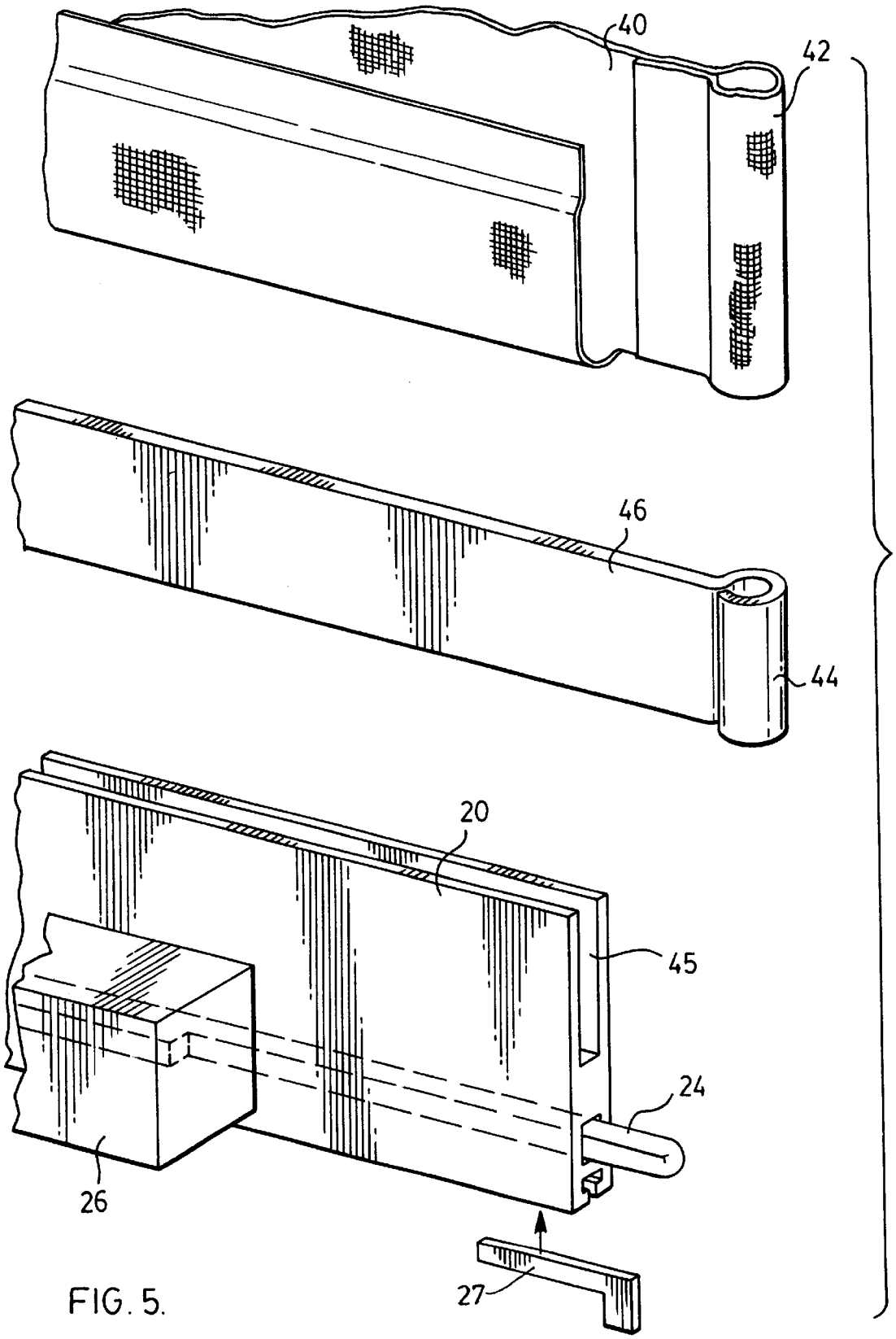
FIG. 5 is an enlarged exploded view of the drawbar, draw bar ring and screen mesh.

Thus, as shown, principally in FIG. 5, the draw bar 20 may slidably mount the stop stud 24 spring biased to extended position by spring means, not shown. Usually handles 26 on the draw bar are laterally slidable to control the position of stop stud 24. Thus the extrusion of the frame may be provided with a series of vertically spaced receptacles for the stop stud 24, not shown, in extrusion 30 so the screen may be set at a desired position for retracted, partially extended or fully extended position.

A guide 27 for the draw bar is shaped to slide in the groove 32 in extrusion 30.

Although the constant tension roller 36 is preferred the roller may be operated like those of older blinds, whereby the screen may be gently parked to remain in an extended or partly extended position, and may then be freed by a downward jerk on the draw bar and released to wind up to a non-extended position.

The screen 18 preferably winds and unwinds in a vertical direction. It is within the scope of the invention however to have the screen unwind from a roller at one side of the opening to an extended position determination at the other side. The screen may also, if desired have the roll at the bottom of the opening to unroll upwardly, toward closed position.

The screen may be formed of any usual screening which may be rolled on the roller 36 However the preferred screen is fibreglass coated with plastic. Other commonly used screens are made of aluminum and plastic.

In the preferred embodiment of the invention the screen material 40 is formed into a tube 42 at each lateral edge and sealed in its tubular attitude by heat welding or gluing.

A guide ring 44 on bar 46 is connected to the screen by looping the bottom end of the screen material 40, over bar 46 and again fastening it in place by heat welding or gluing. The bar 46 is fastened in slot 45 of the draw bar.

In each extrusion 30 there is provided a rod 40 upwardly extending from an attachment 50 on a lower transverse member of frame 16, to a free end 52 below but near roller 36.

The screen is extended through each groove 32 And its tube 42 is pulled over a rod 40 to the extent permitted by the degree of unwinding of the screen.

The screen may then be unrolled or rolled to open or close the opening under the control of drawbar 20. Because the diameter of each lateral tube 42, filled with a draw bar 40, is larger than the width of groove 32, the screen lateral edges are prevented from moving through the groove, thus maintaining the screen opening closed at each lateral edge between the extended portions of the screen and providing a neat screen appearance.

The upward movement of the screen under control of the roller spring and draw bar 20 must have a stop, not shown, to stop upward movement of ring 44 and tube 42 before they may come off the free ends 52 of the rods 40, so that the rods are already in the ring and tube when it is desired to again lower the screen.

After forming the tube 42 and before threading it on the rod, it may be wise to iron the pocket flat in the plane of the remainder of the screen. This will assist the flattening of those parts of the pocket which travel upwardly of rod ends 52 so that the flattened tube may wind up easily on roller 36.

Figure 6:
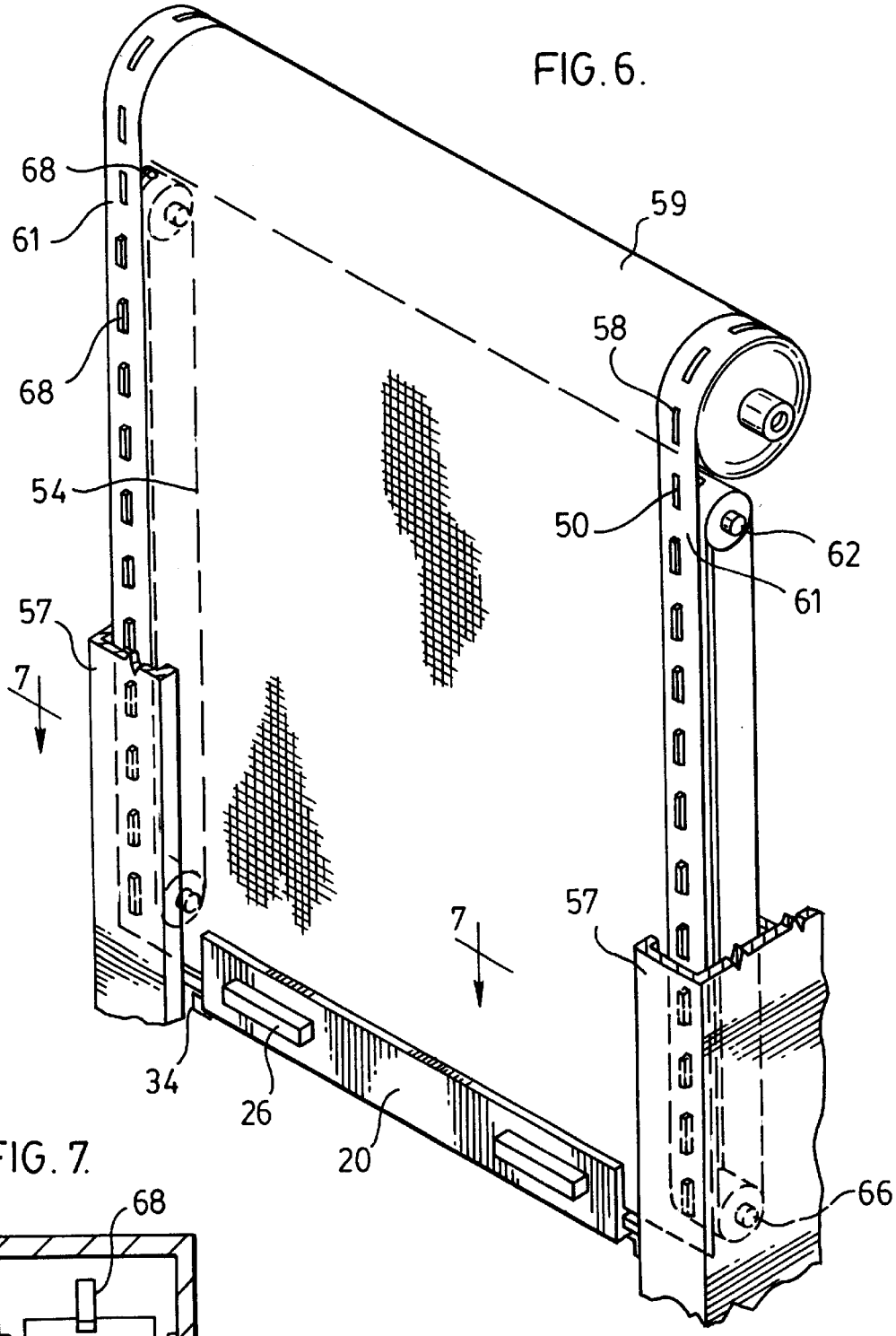
FIG. 6 shows schematically a screen with an alternate means of keeping the screen laterally extended.
Figure 7:
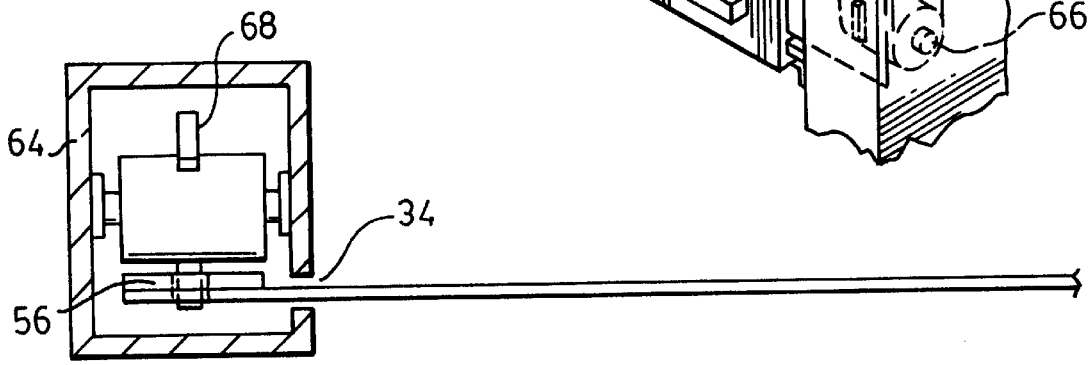
FIG. 7 is a view along the line 7—7 of FIG. 6.

An alternative form of the invention is shown in FIGS. 6 and 7. The screen 54 rolls on or unrolls from roller 59 (which is the same as roller 36). The draw bar 20 and its appurtenances may be attached to screen 54, and with slot defining extrusions 57, control the height and manipulation of the draw bar 20 in the manner described in connection with FIGS. 1 to 5. Roller 59 operates as did roller 36.

The screen 54 is mini-slotted near each lateral edge by longitudinally regularly spaced slots 58. It will frequently be wise to strengthen the slotted area with reinforcing 56 which is also slotted at 58.

An endless belt 61 member is contained in each extrusion 57. The endless belt is attached to a freely rotating wheel 62 at the upper end, which is fixed to the casing by means not shown, and a freely rotating lower pulley 66 whose shaft does not have to be connected to the frame and may float on the belt bight.

Each belt is formed with teeth 68 to shaped and spaced to be received in mini-slots 58. The belt thus rides upwardly or downwardly on the gears 62 and 66, driven by screen mini-slots 58 while preventing the screen lateral edges from escaping through the groove 34.

A stop not shown must be provided to prevent the screen on winding up from moving upwardly off the upper end of teeth 68.

In the embodiment of FIGS. 6 and 7 the reinforced screen must be thin enough to wind on roller 59. The method shown is less preferred than that of FIGS. 1–5.

Any alternate method of thickening or contacting the lateral screen edges so they cannot move inwardly through the screen edges and can wind on a roll is within the scope of the invention.

We claim:

1. Means defining a window frame, including side frame members, and defining a screen opening, a frame member mounting a roll screen movable between rolled up and extended positions, and in one of said extended positions closing a part of said opening, said screen defining opposed lateral edges, each said side frame members including means defining a slot extending in the extension direction defining a path for said screen inwardly spaced from each lateral edge, means preventing each lateral edge of said screen passing through said slot toward the opposite edge, wherein a rod extends upwardly toward the retracted position of said screen outwardly of each slot, said screen being provided with a loop running along each lateral edge dimensioned to slide along and overlie one of said rods, a draw bar for controlling the height of said screen, a bar having a ring slideable on each rod, said last mentioned bar, attached to said screen and to said draw bar.

2. Means defining a window frame including side frame members, and defining a screen opening, a frame member mounting a roll screen movable between rolled up and extended positions, and in one of said extended positions closing a part of said opening, said screen defining opposed lateral edges, each said side frame members including means defining a slot extending in the extension direction defining a part for said screen inwardly spaced from each lateral edge, means preventing each lateral edge of said screen passing through said slot toward the opposite edge, wherein a series of mini-slots runs parallel to each lateral edge and is located outside a slot at extended positions of said screen, an endless belt located outside each of said slots and having teeth dimensioned to mesh with said mini-slots.

3. Means as claimed in claim 2 wherein said screen is strengthened about the location of said mini-slots.

* * * * *